US006666219B2

(12) United States Patent
Raches

(10) Patent No.: US 6,666,219 B2
(45) Date of Patent: Dec. 23, 2003

(54) FAST INTERRUPT OF DISHWASHER HAND SENSOR

(75) Inventor: Scott D. Raches, Jackson, TN (US)

(73) Assignee: Maytag Corporation, Newton, IA (US)

( * ) Notice: Subject to any disclaimer, the term of this patent is extended or adjusted under 35 U.S.C. 154(b) by 119 days.

(21) Appl. No.: 10/093,166

(22) Filed: Mar. 7, 2002

(65) Prior Publication Data

US 2003/0168080 A1 Sep. 11, 2003

(51) Int. Cl.[7] ..... B08B 7/04

(52) U.S. Cl. ..... 134/57 D; 134/18; 134/56 R; 134/56 D; 134/57 R; 134/58 D; 134/58 R; 134/57 DL; 134/58 DL; 134/200; 134/201

(58) Field of Search ..... 134/56 D, 56 R, 134/57 D, 57 R, 58 D, 58 R, 57 DL, 58 DL, 200, 201, 18

(56) References Cited

U.S. PATENT DOCUMENTS 3,924,085 A 12/1975 Stone
4,329,581 A 5/1982 Helfrich, Jr. et al.
4,776,620 A 10/1988 Marks et al.
5,174,618 A 12/1992 Kropf
5,202,582 A 4/1993 Szynal et al.
5,267,582 A 12/1993 Purtilo
5,380,983 A 1/1995 Cavada et al.
5,662,744 A 9/1997 Tuller et al.
5,810,403 A 9/1998 Prada
5,973,417 A 10/1999 Goetz et al.
6,260,565 B1 7/2001 Welch et al.
6,338,352 B1 1/2002 Raches et al.

*Primary Examiner*—Zeinab El-Arini
(74) *Attorney, Agent, or Firm*—McKee, Voorhees & Sease, P.L.C.

(57) ABSTRACT

A dishwasher having the advantage of fast interrupt of the operation of its dishwasher components is disclosed. The dishwasher has an openable cabinet and a washing compartment disposed within the openable cabinet. The dishwasher further includes a handle associated with the openable cabinet for opening the cabinet to provide access to the washing compartment and a sensor in operative communication with the handle such that when a user grasps the handle, the sensor senses the user's presence prior to opening the cabinet so that operation of the dishwasher can be interrupted.

14 Claims, 3 Drawing Sheets

FAST INTERRUPT OF DISHWASHER HAND SENSOR

BACKGROUND OF THE INVENTION

This invention relates to a method and apparatus for a dishwasher. More specifically, this invention relates to a dishwasher having a sensor that provides for the interrupt or shut off of the dishwasher prior to opening.

Dishwashers have conventionally been designed with electrical mechanical latch and switch mechanisms that disconnect power to the dishwasher when the latch is open, but before the dishwasher door is swung open. This configuration allows power to be interrupted to the dishwasher in order to prevent hot water from being sprayed out onto the user and/or the surrounding areas.

It is desirable to use a simpler and alternative means to open a dishwasher. For example, such a dishwasher can include a magnetic or simple pole-latch that allows the dishwasher door to be opened more immediately and more conveniently. One problem with using a magnetic or simple pole-latch to open a dishwasher door is that if the door opens immediately, then the dishwashing machine does not shut off in time to prevent hot water from being sprayed out onto a user potentially causing injury or water damage to the flooring and/or surrounding area.

A further problem involves dishwashing machines, such as drawer-type dishwashing machines, that have inflatable seals. If these inflatable seals are engaged while a dishwasher drawer is pulled open, then these inflatable seals can be damaged. Therefore, although it is desirable to create a dishwasher that can be easily and immediately opened, problems remain.

Thus, it is a primary object of the present invention to provide a method and apparatus for a dishwasher that improves over the state of the art.

It is a further object of the present invention to provide a dishwasher capable of automatically interrupting operation of dishwasher components prior to being opened.

Yet another object of the present invention is to provide a method and apparatus for a dishwasher that prevents hot water from being sprayed out of the dishwasher when the dishwasher is opened.

A further object of the present invention is to provide a method and apparatus for a dishwasher that allows the dishwasher to be easily and conveniently opened.

These and other objects, features, or advantages of the present invention will become apparent from the specification and claims that follow.

BRIEF SUMMARY OF THE INVENTION

The present invention is a method and apparatus for a dishwasher that includes a sensor for sensing that a user intends to open the dishwasher prior to the user opening the dishwasher. The dishwasher has an openable cabinet and a washing compartment disposed within the openable cabinet. A handle is attached to the openable cabinet for opening the cabinet and providing access to the washing compartment. A sensor is in operative communication with the handle such that when a user grasps the handle, the sensor senses the user prior to opening the cabinet. Once the sensor senses the user, a pump and/or sprayer, an inflatable seal, or other dishwashing component can be interrupted or shut off. Thus, a dishwashing component can be interrupted or shut off prior to the dishwasher cabinet being opened.

According to one method, the present invention provides for access to a washing compartment disposed within an openable cabinet of a dishwasher. The method includes sensing that a user intends to access the washing compartment and interrupting one or more functions of the dishwasher after sensing that a user intends to access the washing compartment. The step of sensing can include sensing that the user has broken a light curtain or beam of light or sensing that the user has touched a handle of the dishwasher.

DETAILED DESCRIPTION OF THE INVENTION

Figure 1:
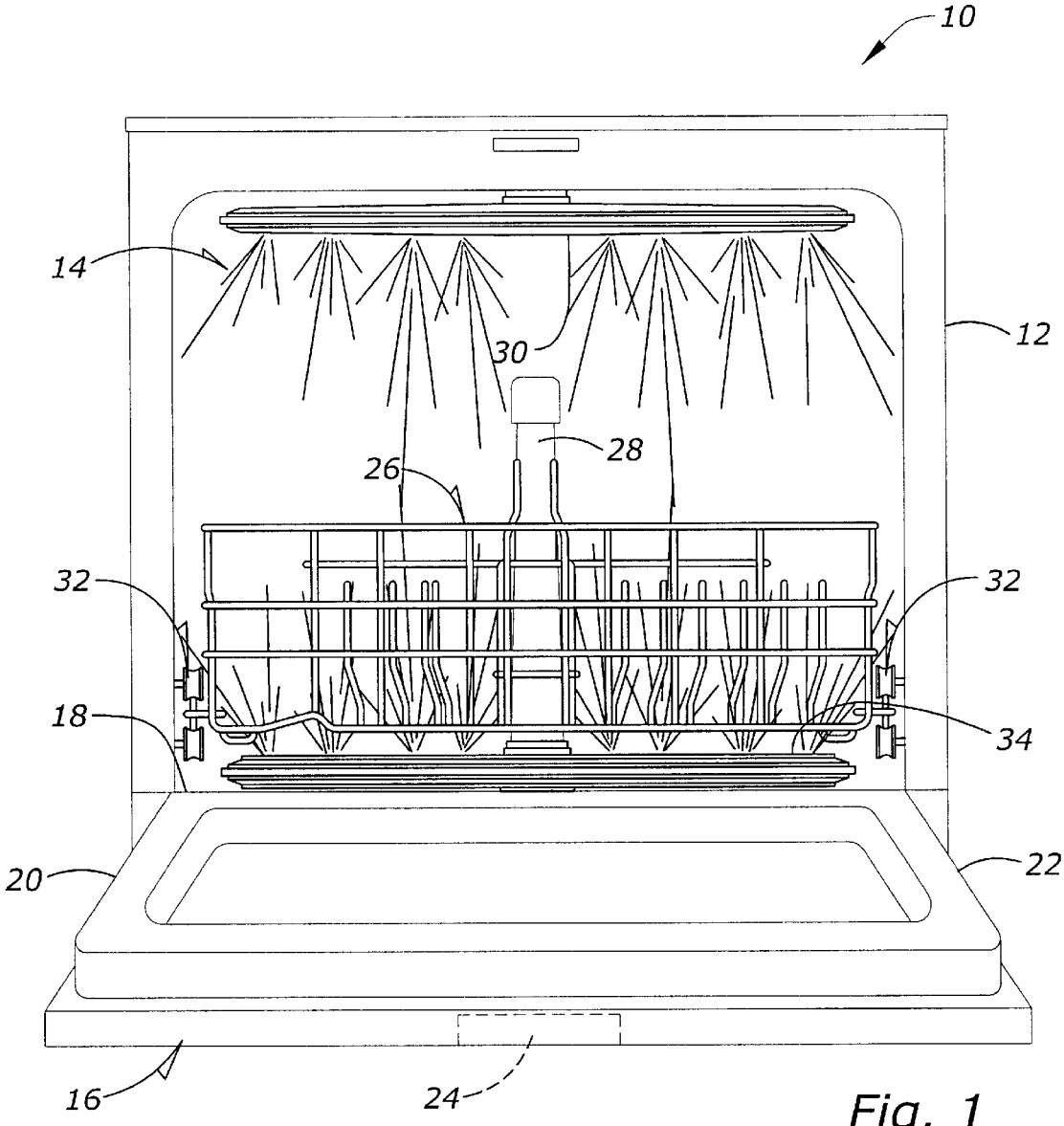
FIG. 1 is a front elevational view showing the cabinet in an open position providing access to the washing compartment.

FIG. 1 illustrates a dishwasher 10. The dishwasher 10 includes an openable cabinet 12. A washing compartment 14 is disposed within the openable cabinet 12. The openable cabinet 12 also includes a door 16 for opening the cabinet 12 and providing access to the washing compartment 14. The present invention contemplates that instead of a door 16, the openable cabinet 12 can be otherwise opened. For example, the dishwasher 10 may be of a drawer type such that the cabinet 12 is opened by opening a drawer. The door 16 shown includes a bottom edge 18 and side edges 20 and 22. In addition, the dishwasher 10 includes a handle 24. The handle 24 can be integral with the door 16, embedded within the door 16, or of other construction. The door 16 can be secured with a magnetic or simple pull-latch (not shown) such that the dishwasher door 16 is easily and conveniently opened.

Within the washing compartment 14, a rack 26 is shown for holding items to be washed. A central spray tower 28 is shown. The central spray tower 28 or other sprayer is used for spraying water. In addition, within the washing compartment 14 are upper washing arms 30 and lower washing arms 34. The rack 26 is mounted on rollers 32 so that the rack 26 can be extended for loading and unloading. The particular configuration of the dishwasher 10 shown is merely one configuration, the present invention contemplates that other configurations may be used.

Figure 2:
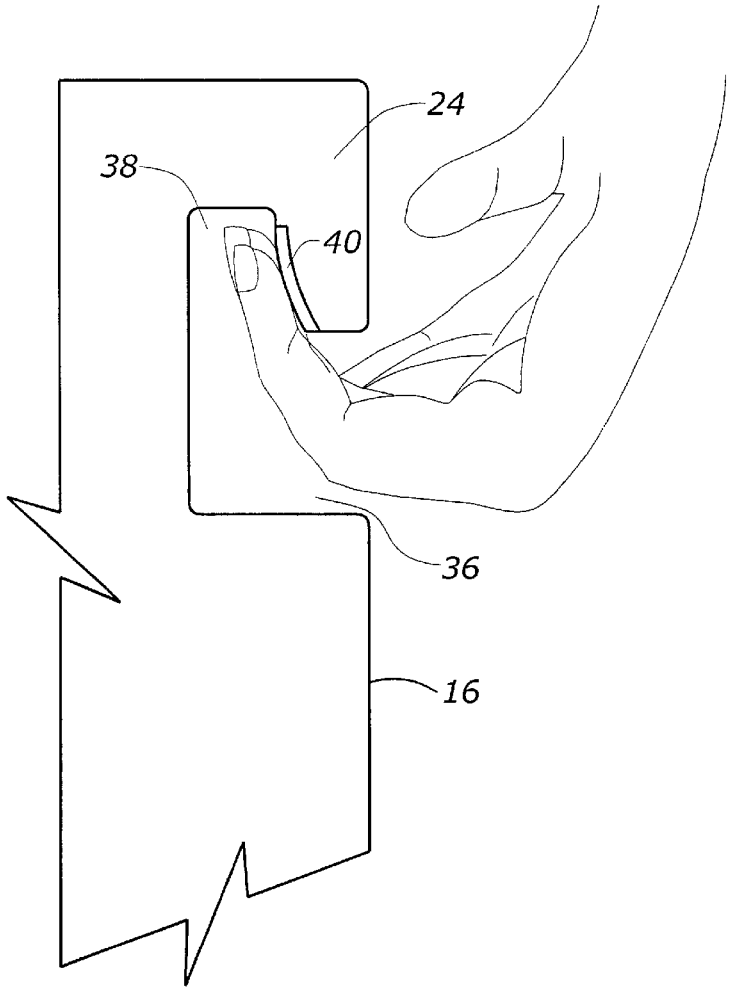
FIG. 2 is a pictorial representation of a user opening the dishwasher of the present invention.

FIG. 2 shows a pictorial representation of a hand of a user opening a door 16 or drawer of the dishwasher 10. As shown in FIG. 2, the door 16 has a handle recess 36. A sensor such as the touch sensitive sensor 40 shown is operatively attached to the handle 24 so that when a user makes contact with the touch sensitive sensor 40, operation of the dishwasher 10 is interrupted. Because the user must touch the handle 24 and thus the touch sensitive sensor 40 in order to open the door 16, the touch sensitive sensor 40 senses the presence and intention of the user to open the door 16 prior to the door 16 being opened.

Figure 3:
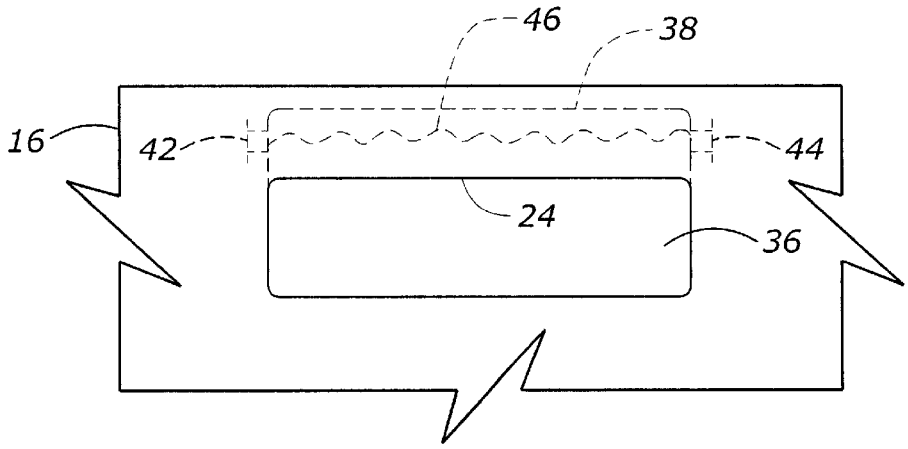
FIG. 3 is a front view of a handle with a sensor according to the present invention.

Another embodiment of the present invention is shown in FIG. 3. In FIG. 3, the recess 36 includes an unexposed portion 38 behind the handle 24. The user reaches into the recess 36 in order to grasp the handle 24. A light beam or curtain 46 is created through use of a light emitter 42. A light receiver 44 is placed opposite the light emitter 42 so that light 46 emitted by the emitter 42 is received by the receiver 44 when the light beam or curtain 46 is unobstructed. A user accesses the washing compartment 14 of the dishwasher 10 by using the handle 24 to open the door 16, thus interrupts the reception of the light 46 in the process of opening the door 16.

The present invention contemplates variations in the type of sensor used. The sensor can be a touch sensitive sensor 40, can include a light emitter 42 and light receiver 44, can include an infrared light emitter and an infrared light receiver or other variations such that the user's intention to open the door 16 or drawer is determined prior to the user's opening of the door 16 or drawer.

Figure 4:
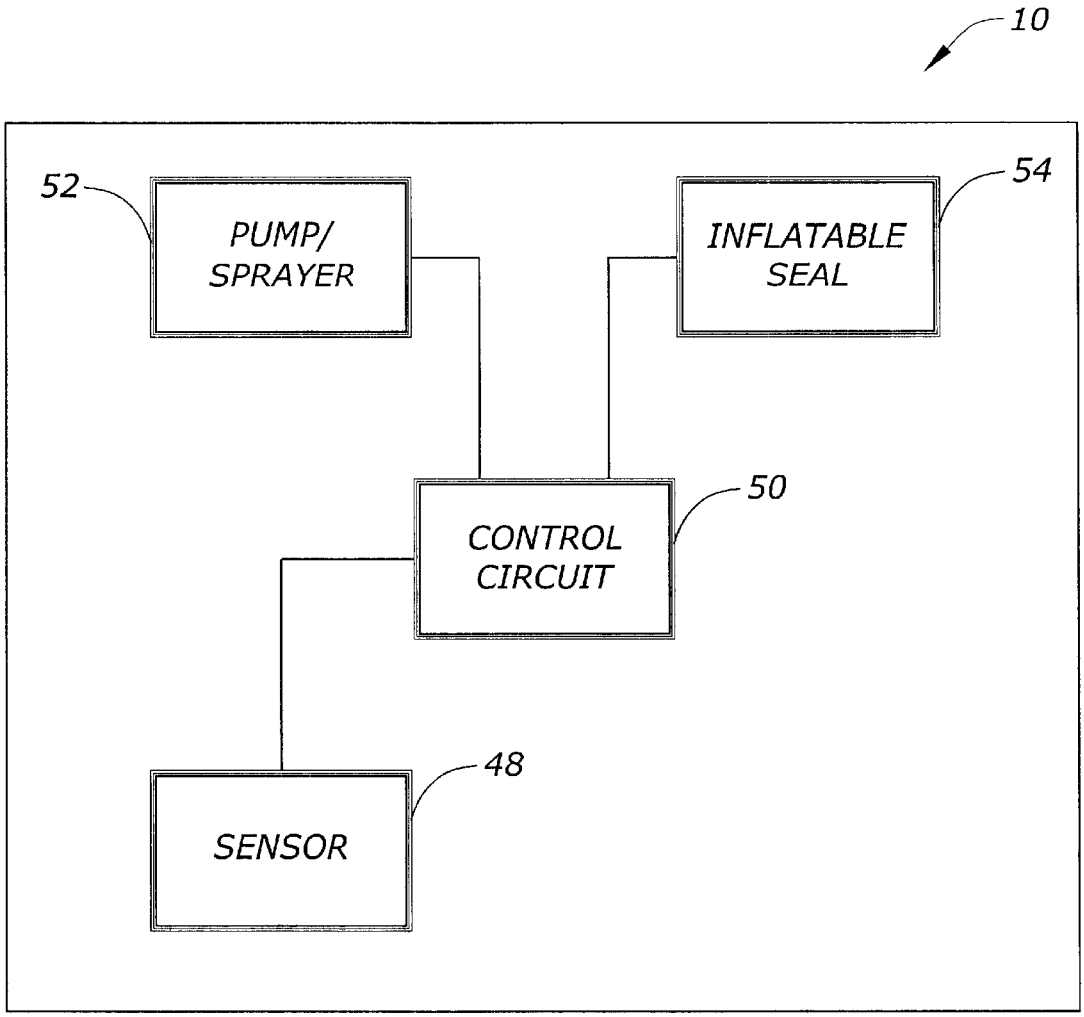
FIG. 4 is a block diagram showing the electrical control of the present invention.

FIG. 4 shows a block diagram of the electronic control of the present invention. As shown in FIG. 4, the sensor 48 is electrically connected to a control circuit 50. The control circuit 50 is operatively connected to a pump/sprayer 52 and an inflatable seal 54. The pump is fluidly connected to the sprayer and the sprayer is disposed within the washing compartment (see FIG. 1). Thus, as shown, the pump and/or sprayer 52 is operatively connected to the sensor 48 so that when a user grasps the handle 24 (see FIGS. 1–3), the sensor 48 engages to interrupt operation of the pump and/or sprayer 52. The pump/sprayer 52 and inflatable seal 54 are merely examples of dishwasher components that can be controlled by the control circuit 50. The present invention contemplates that other dishwashing components can be similarly controlled. According to the present invention, once the sensor 48 senses the user's intention to open the door 16, the operation of the pump/sprayer 52, the inflatable seal 54 or other dishwasher components is interrupted. For example, a pump/sprayer 52 can be simply turned off. This prevents water from being sprayed out onto the user and surrounding areas when the dishwasher door 16 or drawer is opened. An inflatable seal 54 is deflated such as through release of a valve or other means. The control circuit 50 can be an analog circuit such as a circuit including a relay, opto-isolator or other control circuit for disconnecting power or otherwise interrupting operation of dishwasher components. The control circuit 50 can also include a controller, microcontroller, processor, or other intelligent control. Similarly the control circuit 50 can include an integrated circuit or a portion of an integrated circuit. The specific implementation of the control circuit varies according to the environment or specific application.

Thus, a method and apparatus for a dishwasher has been disclosed. The invention provides for variations in the type of sensor used, the configuration of the dishwasher, the manner in which the dishwasher is opened, the dishwasher components that are interrupted, the manner in which dishwasher components are interrupted, and other variations within the spirit and scope of the invention.

What is claimed is:

1. A dishwasher having an openable cabinet and a washing compartment disposed within the openable cabinet, comprising:

a handle associated with the openable cabinet for opening the cabinet to provide access to the washing compartment; and a sensor in operative communication with the handle such that when a user grasps the handle, the sensor senses the user's presence prior to opening the cabinet, thereby interrupting dishwasher operation.

2. The dishwasher of claim 1 further comprising a pump fluidly connected to a sprayer, the sprayer disposed within the washing compartment and the sensor operatively connected to the pump such that when a user grasps the handle, the sensor triggers an interruption in operation of the pump.

3. The dishwasher of claim 1 wherein the sensor includes a light emitter and a light receiver such that when there is no obstruction between the light emitter and the light receiver, the light receiver receives light from the light emitter and when there is an obstruction between the light emitter and light receiver, the light receiver does not receive light from the light emitter.

4. The dishwasher of claim 3 wherein the light is infrared light.

5. The dishwasher of claim 1 wherein the sensor is a touch sensitive sensor.

6. The dishwasher of claim 1 wherein the openable cabinet includes a door, the handle associated with the door.

7. The dishwasher of claim 1 wherein the openable cabinet includes a recess positioned at least partially behind the handle.

8. The dishwasher of claim 7 wherein the sensor includes a light emitter and a light receiver positioned across a longitudinal axis of the recess such that when the user reaches into the recess, the user obstructs the light receiver from receiving light from the light emitter.

9. The dishwasher of claim 1 further comprising an inflatable seal, the sensor operatively connected to the inflatable seal such that when a user grasps the handle, the sensor triggers deflation of the inflatable seal.

10. A dishwasher having an openable cabinet and a washing compartment disposed within the openable cabinet, comprising:

a sensor for sensing a proximity of a user to the openable cabinet prior to the user opening the openable cabinet; and a control circuit electrically connected to the sensor and operatively connected to at least one dishwasher component such that when the sensor senses the proximity of the user to the openable cabinet the control circuit interrupts operation of the at least one dishwasher component.

11. The dishwasher of claim 10 wherein the at least one dishwasher component includes a pump.

12. The dishwasher of claim 10 wherein the at least one dishwasher component includes an inflatable seal.

13. The dishwasher of claim 10 wherein the sensor is a touch sensitive sensor operatively attached to the openable cabinet.

14. The dishwasher of claim 10 wherein the sensor includes a light receiver.

* * * * *